US006681453B1

(12) United States Patent
Hashimoto et al.

(10) Patent No.: US 6,681,453 B1
(45) Date of Patent: Jan. 27, 2004

(54) BUCKLE FOR A PERSONAL ADORNMENT BAND AND A PERSONAL ADORNMENT BAND

(75) Inventors: Norio Hashimoto, Tanashi (JP); Hideo Taguchi, Tanashi (JP); Ryo Fujita, Tanashi (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/743,575

(22) PCT Filed: May 11, 2000

(86) PCT No.: PCT/JP00/03023

§ 371 (c)(1),
(2), (4) Date: Jan. 12, 2001

(87) PCT Pub. No.: WO00/69301

PCT Pub. Date: Nov. 23, 2000

(30) Foreign Application Priority Data

May 13, 1999 (JP) ..... 11/132303

(51) Int. Cl.[7] ..... A44C 5/00; A44B 11/26

(52) U.S. Cl. ..... 24/265 WS; 24/265 BC; 24/71 J

(58) Field of Search ..... 24/265 WS, 265 BC, 24/265 R, 265 EG, 265 H, 633, 640, 68 J, 69 J, 70 J, 71 J, 69 R, 642, 652, 316, 327, 656; 63/12, 3.1, 14.4, 1.11, 14.5, 15.3

(56) References Cited

U.S. PATENT DOCUMENTS

| | | | | | |
|---|---|---|---|---|---|
| 3,696,469 | A | * | 10/1972 | Kalinsky | 24/71 J |
| 4,675,955 | A | * | 6/1987 | Nakamura | 24/265 WS |
| 4,928,359 | A | * | 5/1990 | Gagnebin | 24/587.11 |
| 5,313,691 | A | * | 5/1994 | Hashimoto | 24/265 WS |
| 5,699,590 | A | * | 12/1997 | Erard et al. | 26/265 WS |
| 5,735,629 | A | * | 4/1998 | Sakamoto et al. | 24/265 B |
| 5,749,128 | A | * | 5/1998 | Cuche | 24/265 WS |
| 6,023,816 | A | * | 2/2000 | Okada et al. | 24/265 WS |
| 6,073,316 | A | * | 6/2000 | Ferrario et al. | 24/71 J |
| 6,311,373 | B1 | * | 11/2001 | Hashimoto | 24/265 WS |

FOREIGN PATENT DOCUMENTS

| | | | | |
|---|---|---|---|---|
| JP | 49150709 | | 6/1976 | |
| JP | A7255511 | | 10/1995 | |
| JP | A7327714 | | 12/1995 | |
| JP | 08-056708 | * | 5/1996 | 24/265 WS |
| JP | U3037381 | | 2/1997 | |
| JP | A1057123 | | 3/1998 | |

* cited by examiner

*Primary Examiner*—Anthony Knight
*Assistant Examiner*—André L. Jackson
(74) *Attorney, Agent, or Firm*—Birch, Stewart, Kolasch & Birch, LLP

(57) ABSTRACT

There is provided a supporting member connected to an end of the personal adornment band, a push button slidably mounted in the supporting member, and having a manipulating portion and a hook, a lock member provided in the buckle so as to be engaged with the hook of the push button, and a spring provided in the supporting member for urging the push button outward. An opening is formed by cutting a side wall of the supporting member from an upper plate of the supporting member, thereby leaving a remaining portion at a lower portion of the side wall, and the manipulating portion of the bush button is exposed in the opening.

21 Claims, 20 Drawing Sheets

PRIOR ART

PRIOR ART

PRIOR ART

PRIOR ART

BUCKLE FOR A PERSONAL ADORNMENT BAND AND A PERSONAL ADORNMENT BAND

This application is the national phase under 35 U.S.C. §371 of PCT International Application No. PCT/JP00/03023 which has an International filing date of May 11, 2000, which designated the United States of America.

TECHNICAL FIELD

The present invention relates to a buckle for connecting a personal adornment band such as a watchband and a bracelet to connect the band into a ring.

BACKGROUND ART

There is known a buckle used for a personal adornment band such as a watchband and a bracelet, which is unlocked by pushing push buttons.

FIG. 22 is a perspective view of one example of such a buckle for connecting a pair of watchbands of a watch. The buckle, which is called a triple-folded buckle, has a lower plate 2 connected to a band 1, a middle plate 3 connected to the lower plate, and a surface cover 5 as a supporting member connected to the middle plate and to another band 4. A pair of push buttons 6 are slidably mounted in the surface cover 5 in the lateral direction of the band.

Referring to FIG. 23, the opposite push buttons 6 and elastic members (not shown) for respectively outwardly urging the push buttons are housed in a box-shaped housing frame 7. Each push button is mounted in the frame 7 so as not to move out therefrom by a stopping means not shown. The housing frame is disposed between opposite side walls 5*a* of the surface cover 5, and a manipulating portion 6*a* at the outer end of each push button 6 projecting out from the housing frame protrudes out of an opening 8 formed in the side wall 5*a* of the surface cover.

When the triple-folded buckle is folded, a hook formed in each push button urged by an elastic member engages with a lock member 9 formed on the lower plate, so that the surface cover 5 and the lower plate 2 are engaged, thereby locking the buckle in the closed state.

When the manipulating portions 6*a* of the push buttons are pushed by fingers against the urging of the elastic members, the hooks of the push buttons are disengaged from the lock member 9 so that the engagement between the surface cover and the lower plate is released. Thus the buckle is unlocked, becoming able to be opened again.

In such a buckle, since the manipulating portions 6*a* project out of the surface cover, the push buttons may be depressed when contacting a foreign object. Hence there is a problem that the buckle is inadvertently opened.

Japanese Utility Model Registration No. 3037381 discloses a buckle which overcomes such a defect to a certain degree. FIG. 24 is a perspective view showing the buckle.

The triple-folded buckle has a surface cover 10 having an opening 11 extending from an upper surface of the surface cover to a lower edge along a side surface thereof. An end of a push button 12 is exposed in the opening.

Thus, since the push button 12 does not protrude out of the surface cover 10, the danger of push button being inadvertently depressed is obviated.

Since a recess is formed in the upper surface of the surface cover, a finger of the wearer can be easily inserted through the recess. Hence as shown in FIG. 25, even the push button which does not project out can be easily depressed.

However, the buckle disclosed in Japanese Utility Model Registration No. 3037381 still retains the danger of the push button being inadvertently pushed. More particularly, since the opening extends from the upper surface to the lower end of the side wall of the surface cover, the push button is largely exposed from the side of the surface cover. Hence when an external force is exerted from the side, there is still a danger of the push button being unexpectedly depressed.

In addition, for the ease of pushing the push button with the finger, it is necessary for the push button to have a certain thickness. Therefore, the push button in the above described buckles is produced by machining a thick metal plate by such operation as cutting and pressing. Thus the machining cost is increased, resulting in increase of the manufacturing cost of the buckle.

Moreover, the conventional buckle has various structures for slidably supporting the push buttons in the surface cover as a supporting member. However, there has not been proposed a simple structure where the push buttons are prevented from falling out without fail.

For example in the buckle of FIG. 22, when the push buttons are pushed inside the surface cover, the push buttons may fall out of the surface cover.

In addition, in the buckle of FIG. 24, the housing frame wherein the push button is housed is mounted in the surface cover 10 by spring-loaded pins 14 and 15. Hence the structure of the surface cover becomes complicated, thereby increasing the manufacturing cost.

In addition, a space for the spring-loaded pins becomes necessary so that the surface cover is enlarged, thereby rendering it impossible to provide a compact buckle.

Furthermore, since austenitic stainless steels including nickel which have been heretofore used, are liable to cause metal allergy on skin to which it contacts with, metals which are less liable to cause metal allergy have recently come to be used in personal adornments including buckles. Such metals include titanium, titanium alloys, non-nickel-containing metals such as ferritic stainless steels, and stainless steels having a low percentage of nickel content. However, when these metals are used in push buttons, the repeated contact of the push buttons with the engaging members causes the contacting portions of the push buttons and the engaging members to be quickly abraded, so that the worn and deformed push buttons and engaging members become difficult to engage each other. Thus the buckle cannot be locked.

Japanese Patent Application Laid-Open No. 7-255511 teaches the selective use of different metals when applying metals which are not apt to cause metal allergy as two members which repeatedly contact with each other in a buckle for a watch. However, Japanese Patent Application Laid-Open No. 7-255511 gives no solution for a buckle with push buttons.

Accordingly, the objects of the present invention are:

(1) to provide a buckle wherein the danger of the push buttons being inadvertently depressed is decreased;

(2) to provide a buckle where machining cost is small so as to be inexpensively manufactured;

(3) to provide a buckle having a simple and space-saving structure which is capable of supporting the push buttons in the housing; and (4) to provide a buckle which is unlikely to cause metal allergy to a user and having a high durability even over extended use.

DISCLOSURE OF THE INVENTION

According to the invention, there is provided a buckle for a personal adornment band comprising, a supporting member having an opening and connected to an end of the personal adornment band, a push button slidably mounted in the supporting member, and having a manipulating portion and an engaging portion, a lock member provided in the buckle so as to be engaged with the engaging portion of the push button, an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member, characterized in that the opening is formed by cutting a side wall of the supporting member from an upper plate of the supporting member, thereby leaving a remaining portion at a lower portion of the side wall, and the manipulating portion of the bush button is exposed in the opening.

In accordance with the present structure, even if an external force may be unintentionally exerted from the side of the supporting member, the push button is blocked by the wall remaining portion so that the external force is not applied to the push button. Thus the danger of the buckle becoming released by inadvertent depressing of the push button is avoided.

According to another aspect of the invention, there is provided a buckle for a personal adornment band comprising, a supporting member having an opening and connected to an end of the personal adornment band, a push button slidably mounted in the supporting member, and having a manipulating portion and an engaging portion, a lock member provided in the buckle so as to be engaged with the engaging portion of the push button, an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member, characterized in that the manipulating portion comprises an upright portion and a folded portion extending inward from the upright portion and has a substantially L shaped section.

In accordance with the present structure, the push button can be easily manufactured by bending a plate member. Since the thickness of the manipulating portion can be increased, the push button can be easily depressed with a finger. An inexpensive push button can thus be manufactured while still retaining the operability of the push button.

According to a further aspect of the invention, there is provided a buckle for a personal adornment band comprising, a supporting member having an opening and connected to an end of the personal adornment band, a push button slidably mounted in the supporting member, and having a manipulating portion and an engaging portion, a lock member provided in the buckle so as to be engaged with the engaging portion of the push button, an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member, characterized in that a guide housing for housing the push button and the elastic member is provided, and the guide housing is supported by projections projecting from inner walls of the supporting member.

In accordance with the present structure, not only can the push button be supported in the supporting member in a simple and space-saving manner, but also the push button is reliably prevented from falling out.

According to a still further aspect of the invention, there is provided a buckle for a personal adornment band comprising, a supporting member having an opening and connected to an end of the personal adornment band, a push button slidably mounted in the supporting member, and having a manipulating portion and an engaging portion, a lock member provided in the buckle so as to be engaged with the engaging portion of the push button, an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member, characterized in that the manipulating portion of the push button is made of a metal unlikely to cause metal allergy on skin, and an abutting portion abutting against the lock member is made of metal different from metal of the manipulating portion.

In accordance with the present structure, since a metal unlikely to cause metal allergy on skin is used for the manipulating portion which contacts the skin, the danger of causing metal allergy to the wearer of the personal adornment band is decreased. In addition, for a hook which contacts the engaging portion of a lock projection, a metal having a high durability against abrasion and bending can be employed. Hence, a durable buckle which do not cause the wearer metal allergy is provided.

BEST MODE FOR EMBODYING THE INVENTION

First Embodiment

Figure 1:
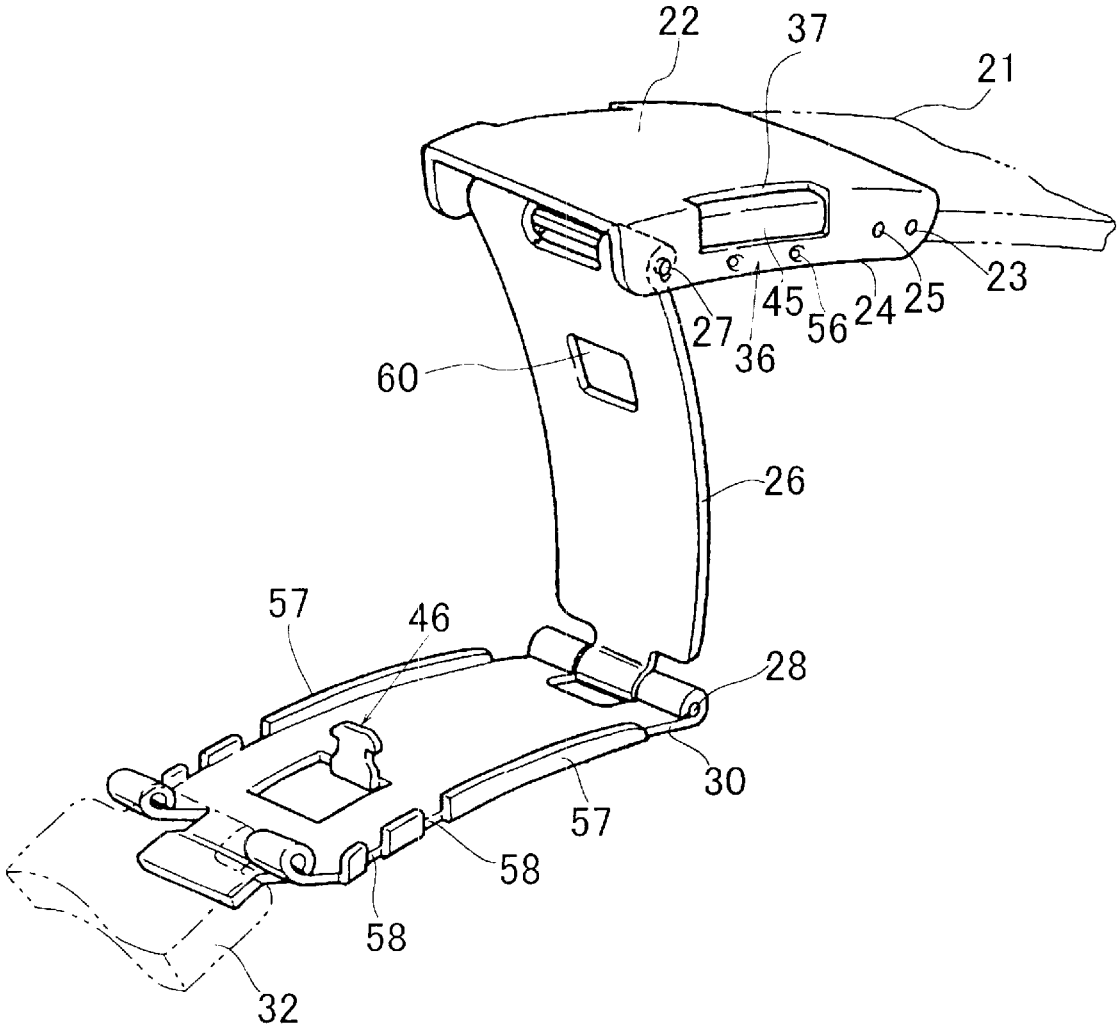
FIG. 1 is a perspective view of a first embodiment of the present invention.
Figure 2:
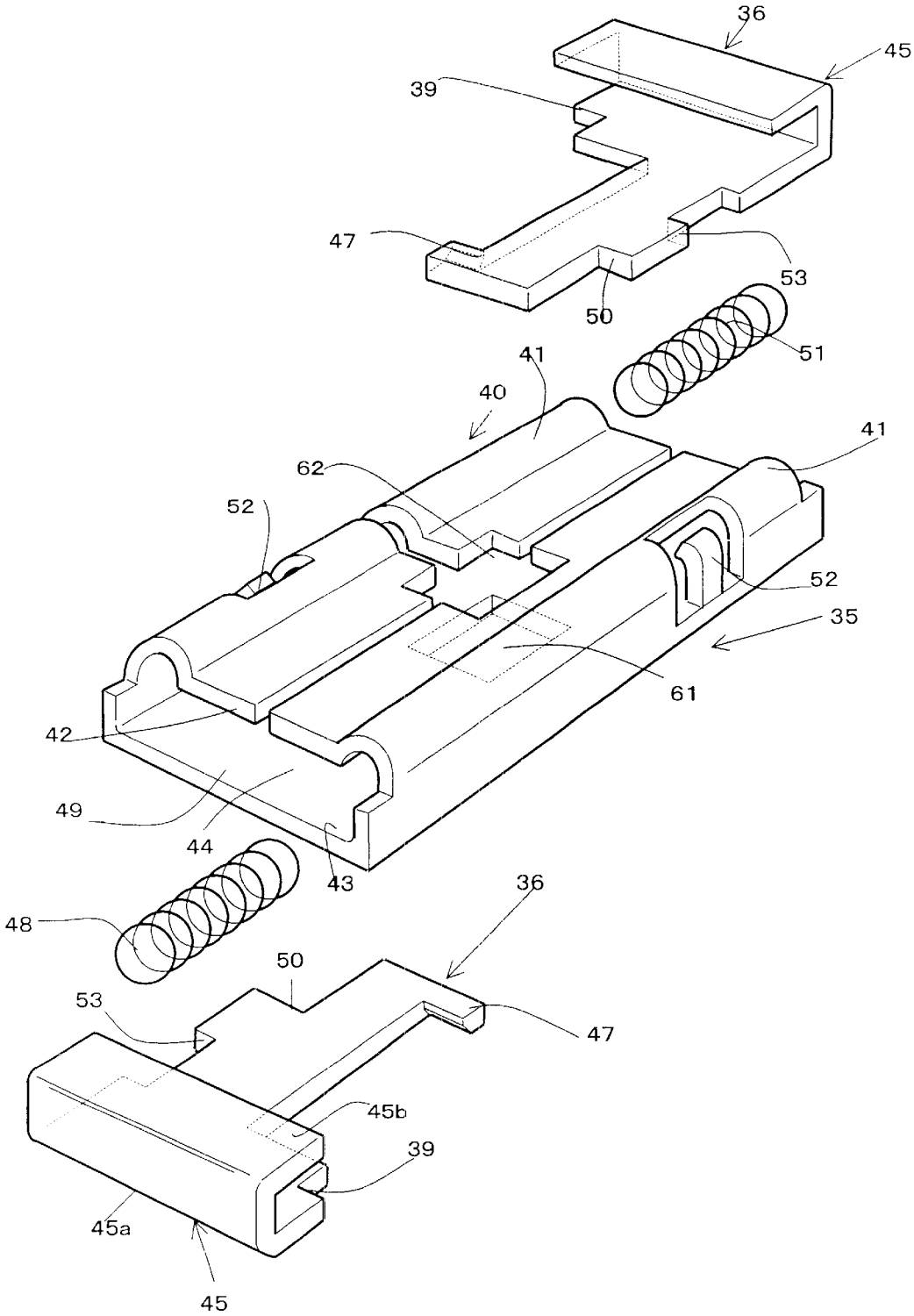
FIG. 2 is an exploded perspective view of a main part of a buckle according to the present invention.
Figure 3:
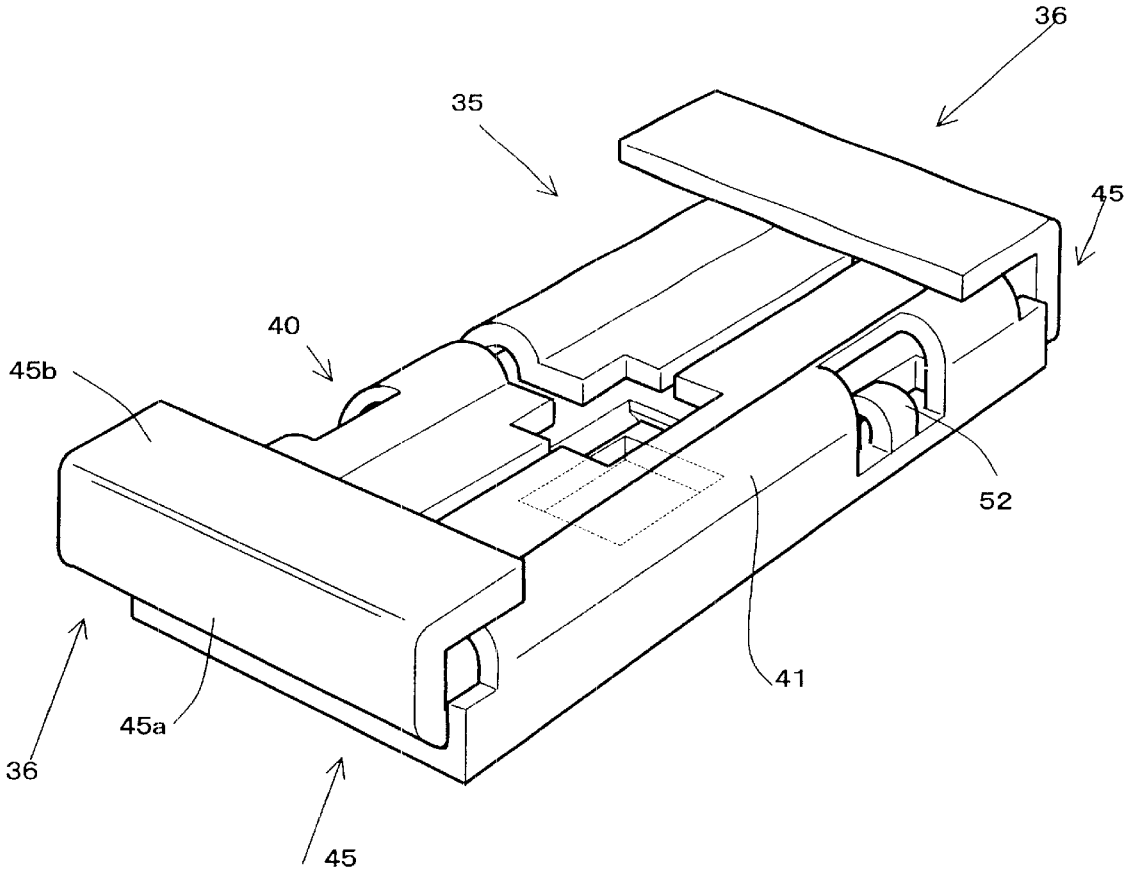
FIG. 3 is a perspective view of the main part.
Figure 4:
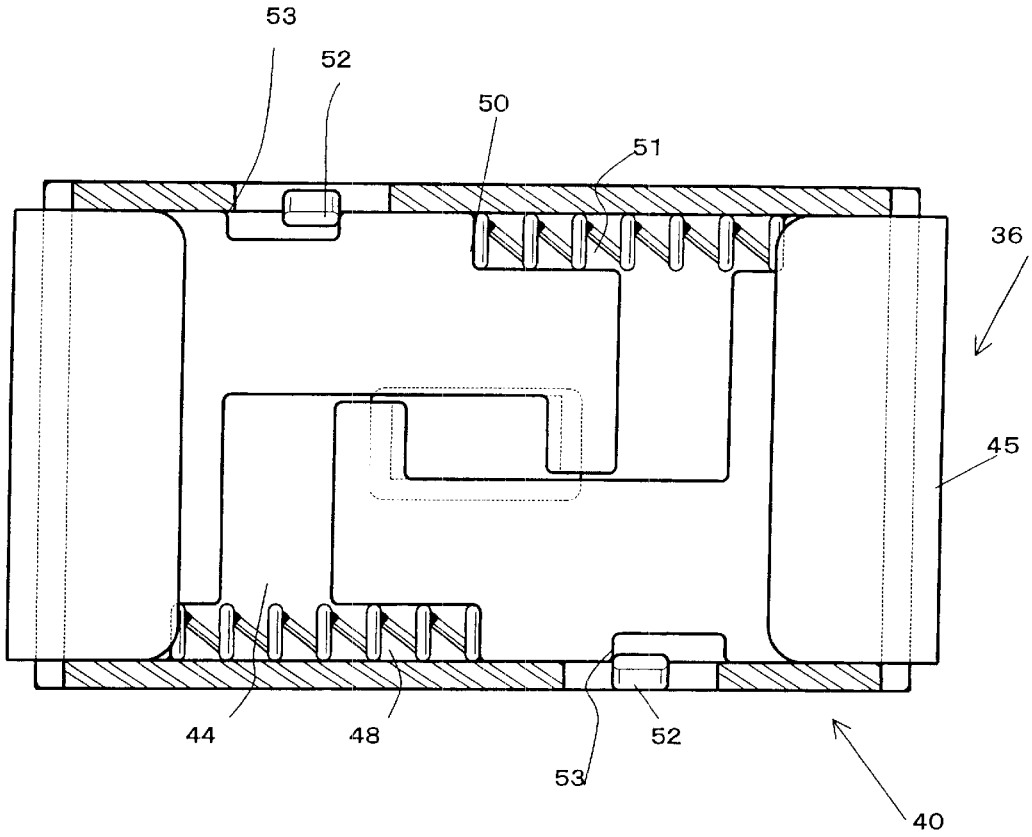
FIG. 4 is a sectional plan view of the main part.

FIG. 1 is a perspective view of the first embodiment of the present invention, FIG. 2 is an exploded perspective view of a lock device according to the present invention, FIG. 3 is a perspective view of the assembled lock device, and FIG. 4 is a sectional plan view of the lock device.

Referring to FIG. 1, an end of a surface cover 22 as a supporting member is rotatably connected to an end of a band 21 by a spring-loaded pin 23. The spring-loaded pin 23 selectively engages with a pair of opposite mounting holes 25, a plurality of which are formed in side walls 24 of the surface cover 22, so that the length of the band is adjusted.

At the end of the surface cover 22, an end of a middle plate 26 is rotatably connected by a pin 27, and the other end of the middle plate is rotatably connected to an end of a lower plate 30 by a pin 28. A base end of the lower plate 30 is rotatably connected to an end of another band 32 by a pin (not shown), thereby forming an annular band.

In each of the opposite side walls 24 of the surface cover 22, there is formed a narrow and elongated opening 37 wherein a manipulating portion 45 of each push button 36 of a lock device 35 (FIG. 2) is inserted.

As shown in FIGS. 2 and 3, the lock device 35 has a guide housing 40 as a housing member having a section adapted to coincide with the periphery of the opening 37, the pair of push buttons 36 slidably inserted in the guide housing, and a pair of springs 48 and 51 for outwardly urging the corresponding push buttons 36.

The guide housing 40 and push buttons 36 are both formed by cutting and bending a thin metal plate. The guide housing 40 has a rectangular shape elongated in a lateral direction of the band, and further has a cylindrical portion 41 at each side thereof. Hence, a guide space 44 is defined by a pair of uppers plates 42 which are positioned at an intermediate portion of the rectangular and a lower plate 43 for slidably mounting the push buttons 36 therein. Each cylindrical portion 41 is slightly shorter than the lower plate 43 so as to form an extended edge portion 49 at each end of the guide housing 40.

The push buttons 36 are constructed in a point symmetry, a base of each of which is bent into a shape of an inverted L to form the manipulating portion 45 comprising an upright portion 45*a* standing upward from the base and a folded portion 45*b* bent inward, forming a gap between the base and the folded portion, and having a sufficient size in the vertical direction for depressing the push buttons with a finger.

At an end of each push button, there is formed a hook 47 which is an engaging portion for engaging a lock projection 46 (FIG. 1) of the lower plate 30, which will later be described. At one side, a first abutting portion 50 for receiving one of the coil springs 48 is formed and at the other side, a second abutting portion 39 for receiving the other coil spring 51 is formed. The springs 48 and 51 are inserted in the corresponding cylindrical portions 41 of the guide housing 40 so that the springs 48 and 51 are prevented from winding.

Referring to FIG. 4, each of the push buttons 36 is inserted from the longitudinal end of the guide housing 40 into the guide space 44. The push button compresses the spring, and a stopping lug 52 is inwardly bent so as to abut the lug against a shoulder 53 formed on a side of the push button. Hence the coil springs 48 and 51 are held compressed, thereby outwardly urging the push buttons.

Figure 7:
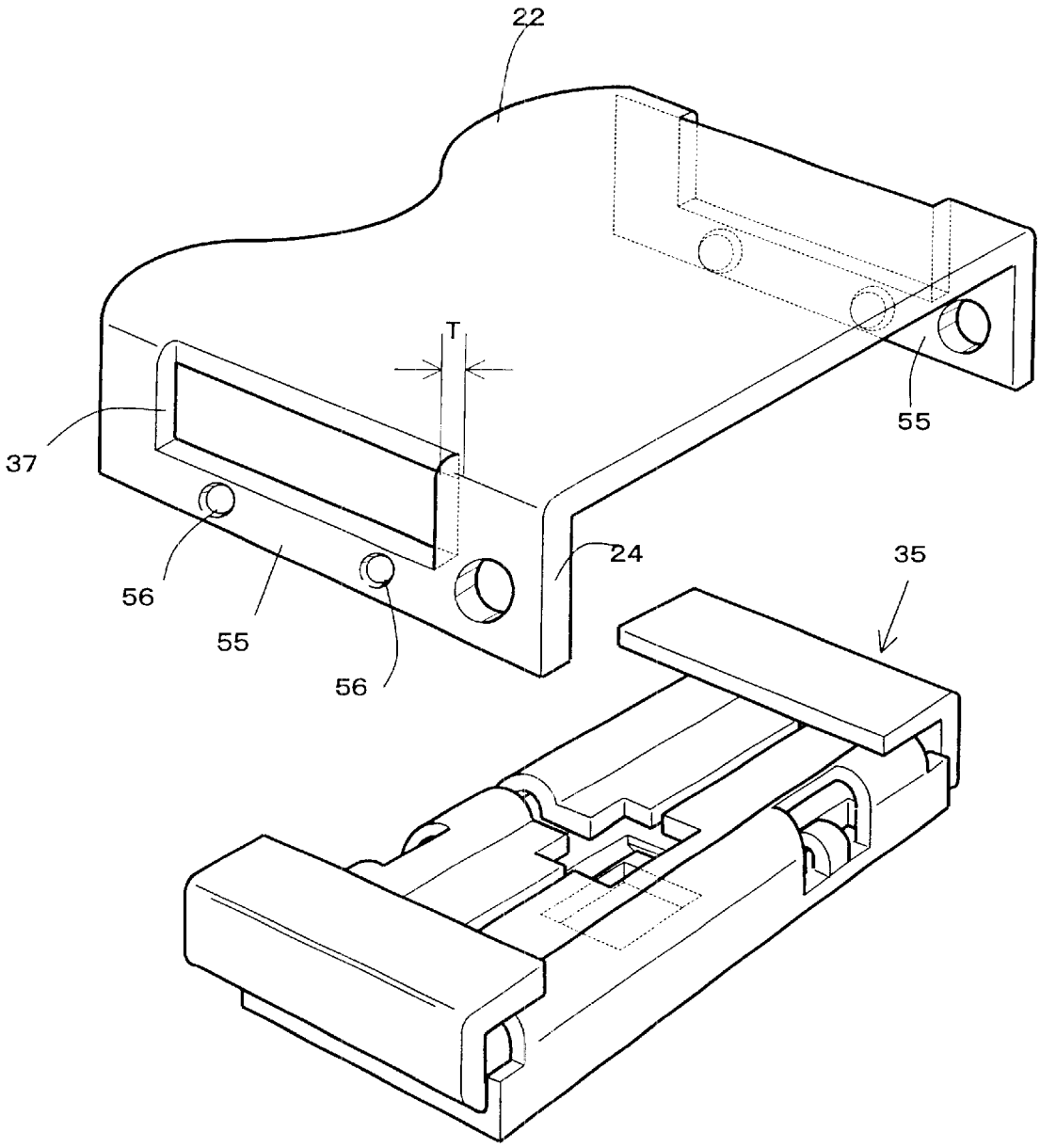
FIG. 7 is an exploded perspective view of the buckle of the present invention.

On the other hand, as shown in FIG. 7, each of the openings 37 extends from the upper edge of the side wall 24 to a position slightly above the lower edge thereof, thereby forming a supporting portion 55 remaining at the lower portion. The upper plate of the surface cover is cut out from the edge a quantity corresponding to a thickness T of the plate forming the side walls 24 of the surface cover.

Figure 9:
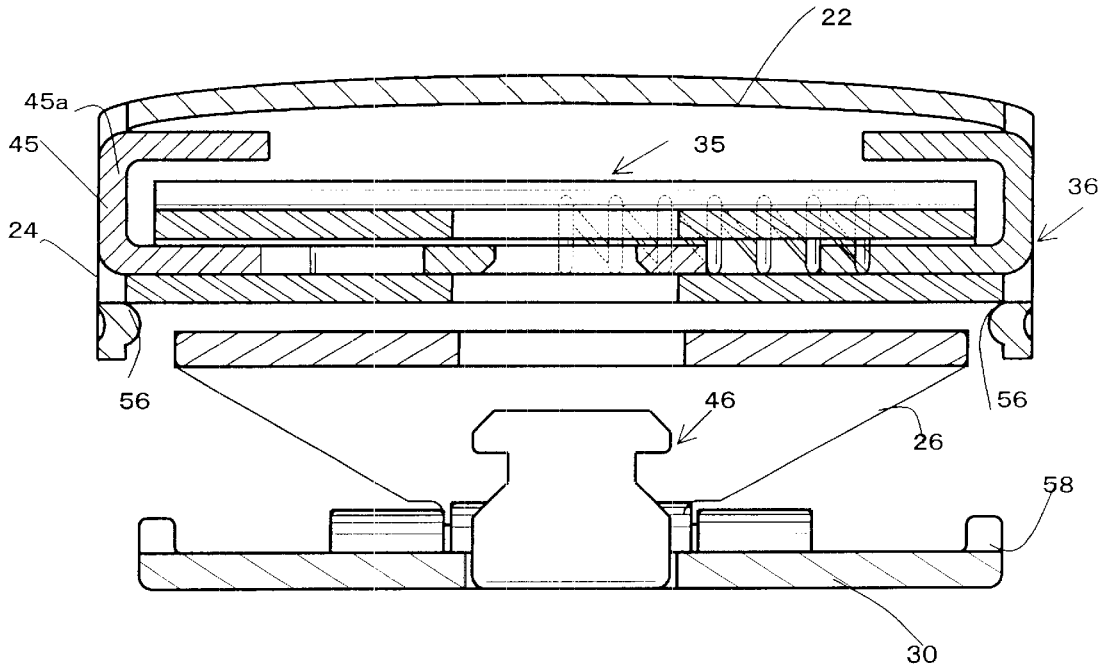
FIG. 9 is a sectional elevational view for explaining the operation.

As shown in FIG. 9, the plate thicknesses of the surface cover 22, bases of the push buttons, and the manipulating portions of the push buttons are substantially equal to one another.

On an inner side of each supporting portion 55, there are formed a pair of supporting lugs 56 each of which projecting inward as shown in FIGS. 7 and 9. As shown in FIG. 9, when the guide housing 40 is housed in the surface cover 22, the extended edge portions 49 at the both sides rest on the supporting lugs 56 so as to hold the guide housing 40.

Figure 8:
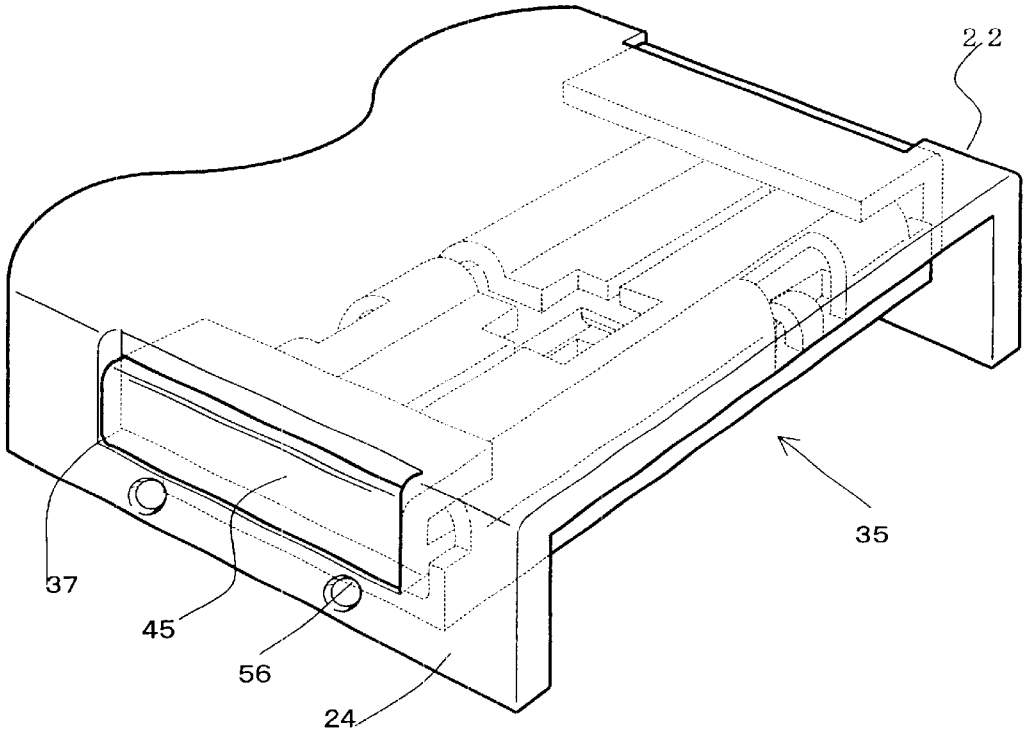
FIG. 8 is a perspective view of the buckle.

As shown in FIGS. 8 and 9, only a part of the manipulating portion 45 of each push button 36 corresponding to the plate thickness of the upright portion 45*a* is inserted into the opening 37 of the surface cover 22. Hence the outside surface of the upright portion 45*a* of each push button is substantially flush with the side surface of the side wall of the surface cover 22.

Figure 5:
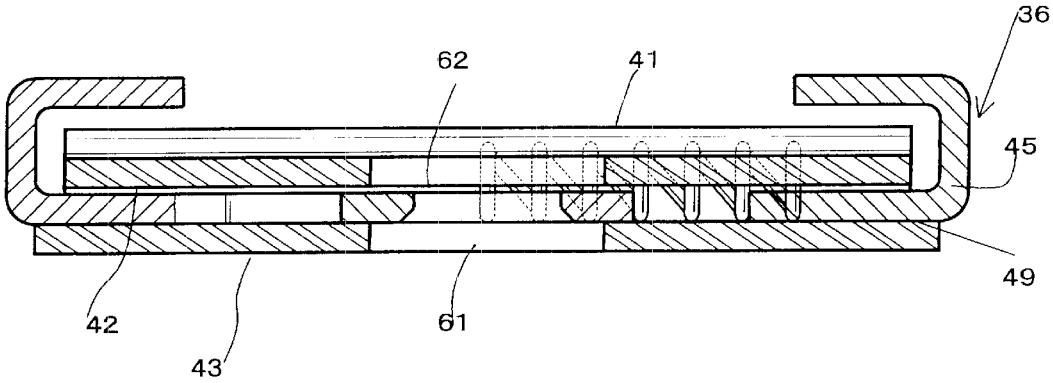
FIG. 5 is a sectional elevational view of the main part.
Figure 6:
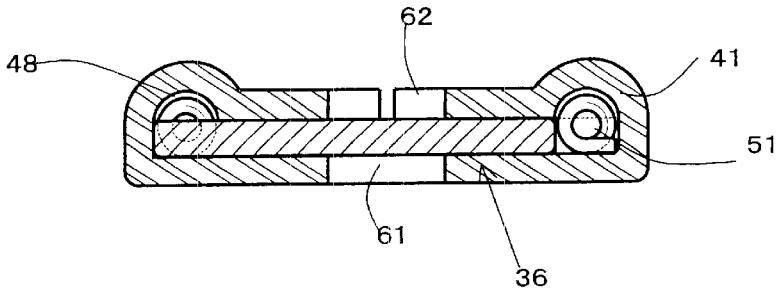
FIG. 6 is a sectional side view of the main part.

As shown in FIG. 1, the lower plate 30 has a lock projection 46 as a lock member formed by cutting out and raising at a substantially center portion thereof, and a pair of upright portions 57 formed at the sides for reinforcement. A pair of recesses 58 are formed in each upright portion 57 with which supporting lugs 56 formed on the inner wall of the surface cover 22 engage when the buckle is closed. In addition, an opening 60 is formed in the middle plate 26 and openings 61 and 62 are formed in the guide housing 40 (FIG. 5) so as to allow the lock projection 46 to pass through.

Figure 10:
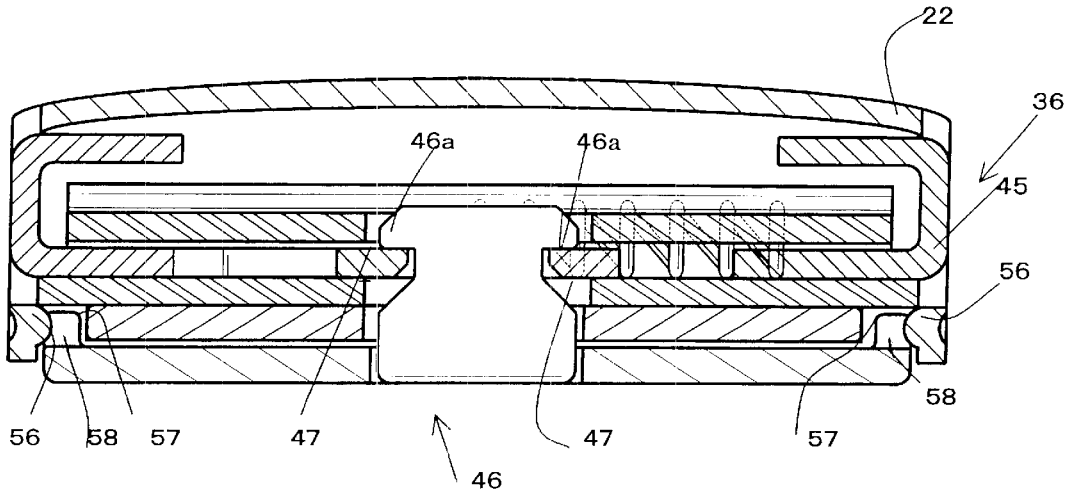
FIG. 10 is a sectional elevational view of the buckle.

In order to wear the watch on a wrist, the buckle is opened as shown in FIGS. 1 and 9. When the surface cover 22 and the middle plate 26 are folded so that the surface cover is forcibly depressed toward the lower plate 30, a lower slant 47*a* (FIG. 11) formed on the hook 47 of each push button 36 abuts against an upper slant 46*b* of the lock projection 46. The slants render the push buttons to move outward against the urgings of the springs 48 and 51. When the slants pass the top portion of the lock projection 46, the push buttons 36 return by the springs so that the hooks 47 engage with the engaging portions 46*a* of the projection 46 as shown in FIG. 10, thereby locking the buckle. At that time, as shown in FIG. 10, the supporting lugs 56 of the surface cover 22 are inserted in the corresponding recesses 58 in the upright portions 57 of the lower plate 30.

Figure 11:
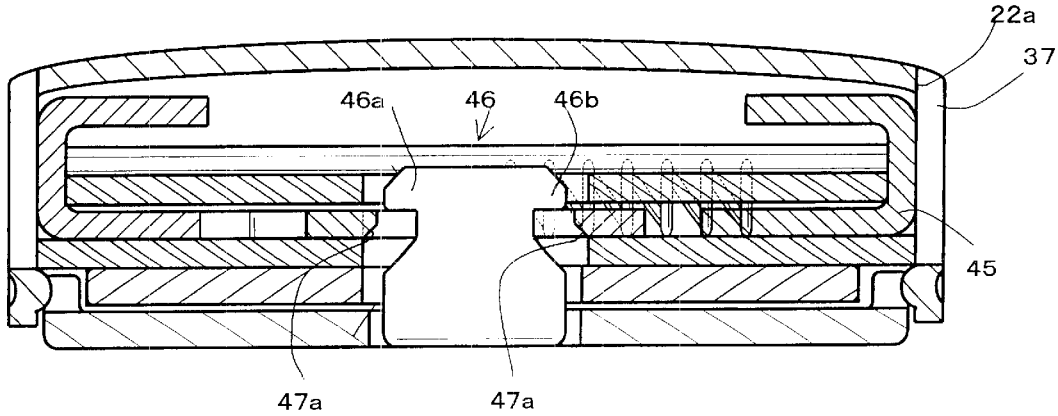
FIG. 11 is a sectional elevational view for explaining the operation.

In order to unlock the buckle and remove the watch, the manipulating portions 45 of the push buttons 36 are simultaneously depressed with a thumb and forefinger. The fingers are stopped by edges 22*a* of the surface cover 22 at the opening 37 as shown in FIG. 11 so that the push buttons 36 are forced inward a quantity corresponding to the plane thickness of the surface cover 22, that is the plane thickness of the upright portions 45*a* of the push buttons 36. At that time, the hooks 47 are disengaged from the engaging portions 46*a* so as to unlock and open the buckle, thereby enabling to remove the watch.

In accordance with the first embodiment, since the remaining portions of the supporting portion 55 (FIG.7) of the surface cover are retained at the lower portion of the openings in which the push buttons are inserted, a foreign object, blocked by these remaining portions, is unlikely to collide against the push buttons, thereby preventing the buckle from releasing and the watch falling.

Second Embodiment

Figure 12:
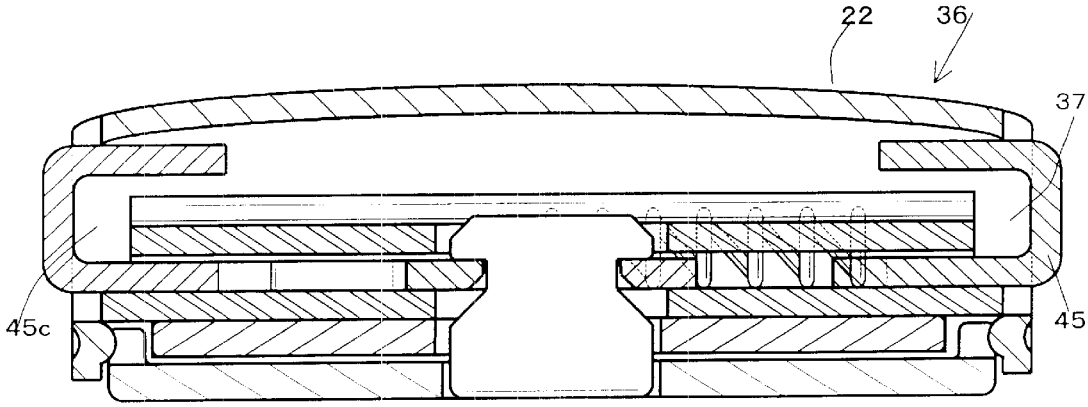
FIG. 12 is a sectional elevational view of a second embodiment of the present invention.
Figure 13:
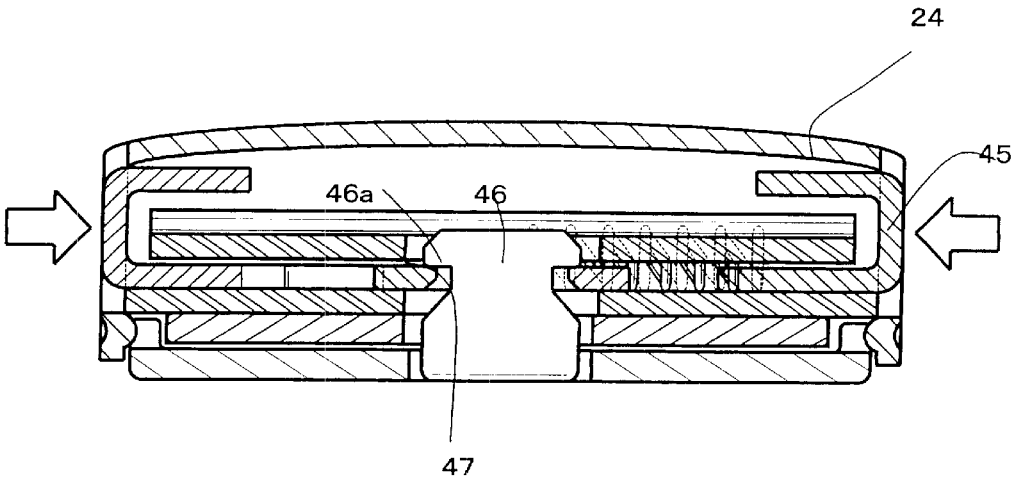
FIGS. 13 and 14 are sectional elevational views for explaining the operation.
Figure 14:
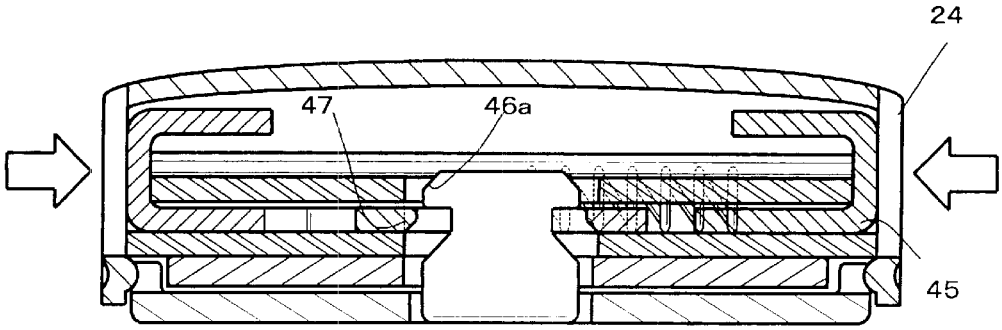

FIGS. 12, 13 and 14 are sectional views of the second embodiment each taken in the lateral direction of the band. The same parts as the first embodiment are designated by the same references in the figures, thereby simplifying the descriptions thereof.

Referring to FIG. 12, in each of the push buttons 36, the stopping lug 52 and the shoulder 53 (FIG. 2) are so disposed that the manipulating portion 45 projects out from the side wall of the surface cover 22 only a quantity corresponding to the plate thickness of the manipulating portion.

By rendering each manipulating portion 45 to stay at such a position that a hollow space 45*c* therein is not shown, the appearance is not deteriorated. Alternatively, the manipulating portions may be projected out only a quantity less than the plate thickness.

In the present embodiment, although the manipulating portions 45 are depressed as shown in FIG. 13 so as to become flush with the outer surfaces of the side walls 24, the hooks 47 of the push buttons 36 are not released from the respective engaging portions 46*a* of the lock projections 46. Thus the buckle is not opened although an inadvertent external force may be applied to the manipulating portions 45.

When the push buttons are further depressed a quantity corresponding to the thickness of the side walls of the surface cover as shown in FIG. 14, the hooks 47 are disengaged from the engaging portions 46*a*, thereby enabling to open the buckle.

In accordance with the second embodiment, the manipulating portions 45 of the push buttons project out from the openings 37 so that it is easy to depress. Moreover, since the lock is not released by the regular stroke, the buckle is not unexpectedly opened.

Third Embodiment

Figure 15:
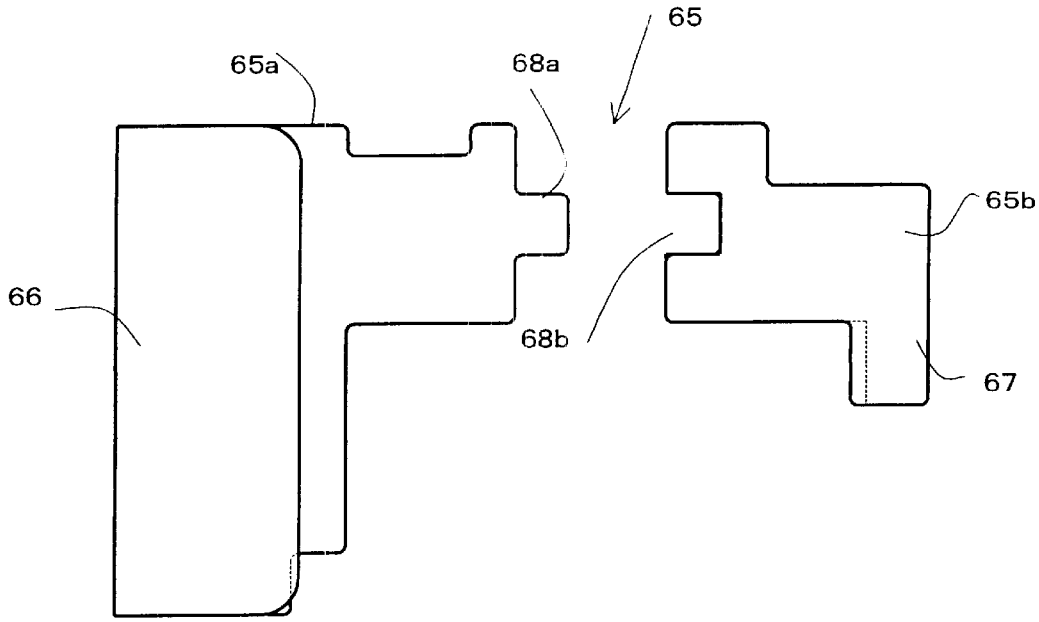
FIGS. 15 and 16 are plan views showing a third embodiment of the present invention.
Figure 16:
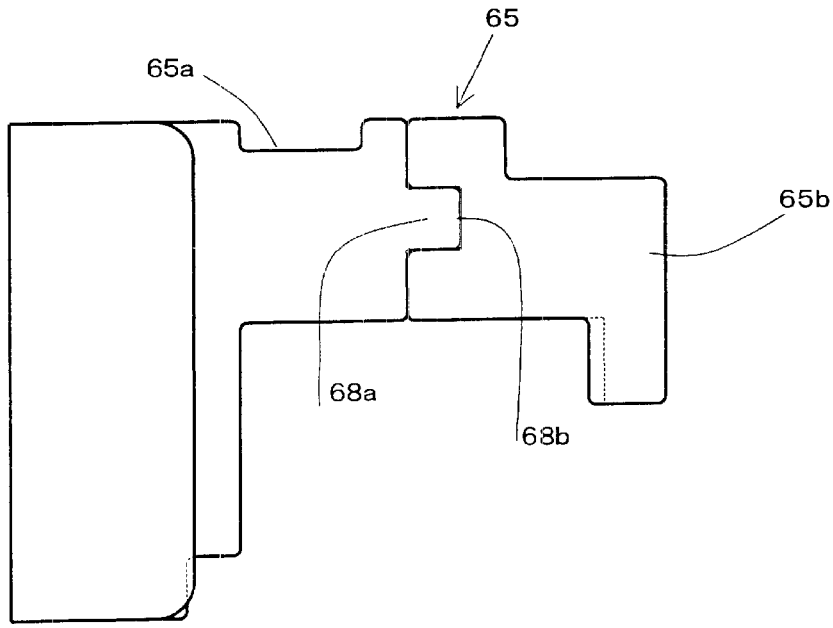
Figure 17:
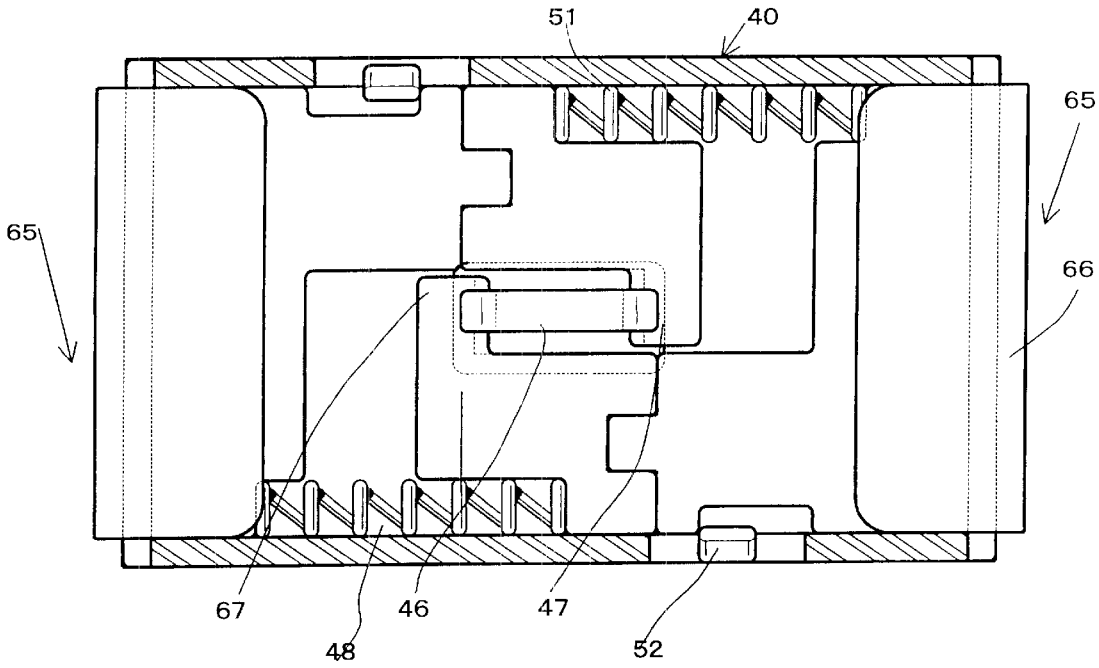
FIGS. 17 and 18 are sectional plan views for explaining the operation.
Figure 18:
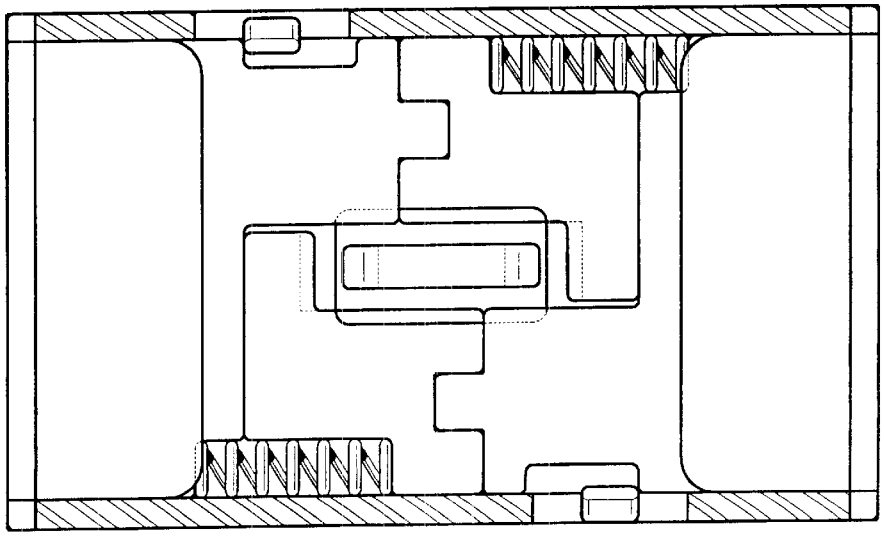

FIGS. 15 and 16 are plan views showing the third embodiment of the present invention, and FIGS. 17 and 18 are plan views showing push buttons assembled in the guide housing.

Each push button 65 which are provided in a pair comprises a base 65*a* including a manipulating portion 66 and an end portion 65*b* including a hook 67.

The base 65*a* having the manipulating portion 66 which contacts the skin of the user is made of a metal which is less likely to cause metal allergy such as titanium, titanium alloy, ferritic stainless steels, and stainless steels containing small quantity of nickel in percentage.

On the other hand, since it naturally does not matter if the end portion 65*b* causes metal allergy, it is made of a strong metal having durability against repeated contact with the engaging portion of the lock projection, such as austenitic stainless steels.

The base 65*a* has an engaging projection 68*a* and the end portion 65*b* has a recess 68*b* which engages with the projection.

As shown in FIG. 16, the projection 68*a* and the recess 68*b* are engaged with each other and the base 65 and the end portion 56*b* are fixed together by staking, adhering, brazing or by welding.

FIGS. 17 and 18 show the push buttons assembled in the guide housing 40 where other constructions are the same as in the first embodiment, thereby designating the same parts therein with the same references as described in the first embodiment.

In accordance with the present embodiment, there are provided push buttons which may prevent metal allergy from occurring, and which are in addition durable. Moreover, it is preferable that the surface cover, middle plate and the lower plate including the lock projection which are touched by the wearer are made of a metal which do not, or are less liable to cause metal allergy. The guide housing 40 may be made of an austenitic stainless steel, same as the end portion 65*b*.

Fourth Embodiment

Figure 19:
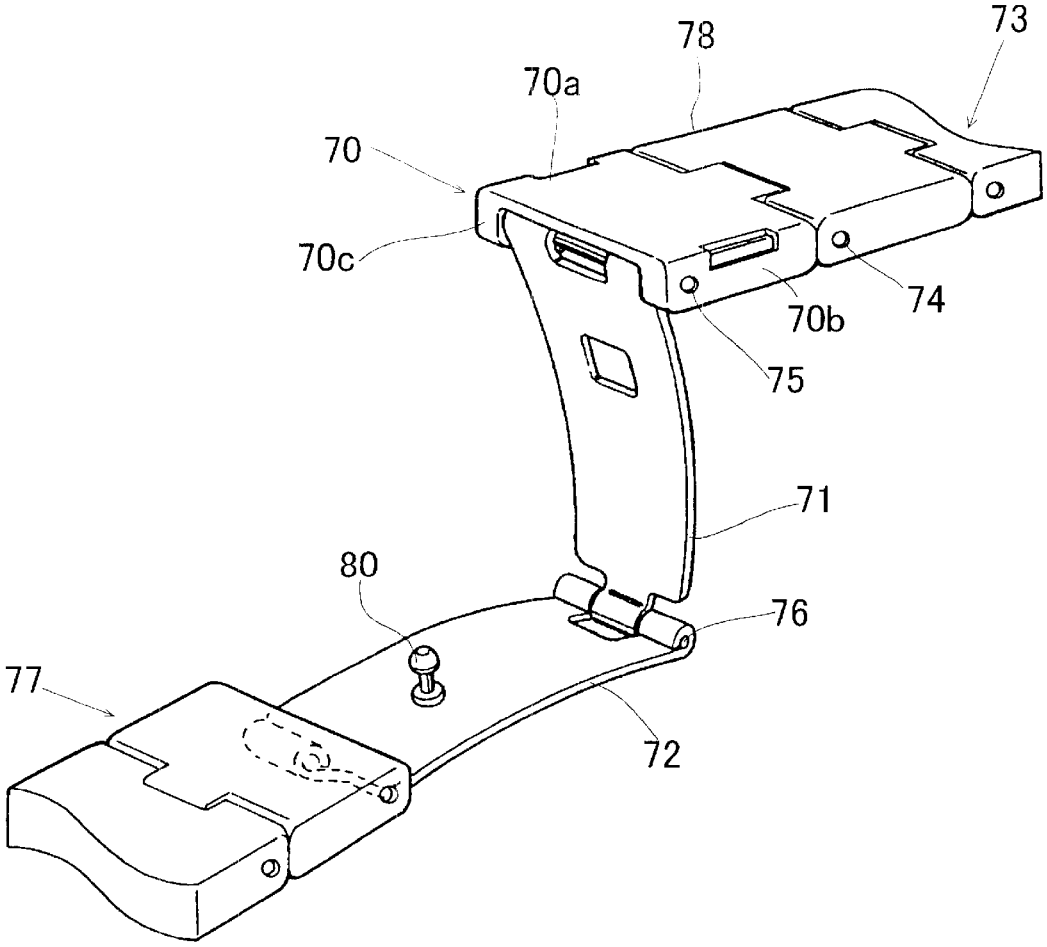
FIG. 19 is a perspective view showing a fourth embodiment.

FIG. 19 is a perspective view showing the fourth embodiment. The buckle comprises a surface cover 70, middle plate 71, and a lower plate 72. The surface cover 70 is rotatably connected to an end of a band 73 by a spring-loaded pin 74, and at another end of the surface cover 70, an end of the middle plate 71 is rotatably connected by a pin 75. The other end of the middle plate is rotatably connected to an end of the lower plate 72 by a pin 76. A base end of the lower plate 72 is rotatably connected to an end of another band 77 by a pin (not shown).

The surface cover 70 is made in the same shape and size as a link 78 of the band. That is, the surface cover comprises an upper plate 70*a*, a pair of side walls 70*b*, an end wall 70*c*, and a bottom plate not shown. The inner portion is hollow and a lock device having the same construction as that of the first embodiment is provided therein.

Meanwhile, a lock projection 80 having a shape different from that of the hereinbefore described embodiments is provided on the lower plate 72.

In accordance with the present embodiment, the surface cover 70 has the same shape as the link 78 so that the existence of the buckle becomes obscure, thereby improving the appearance of the band.

Fifth Embodiment

Figure 20:
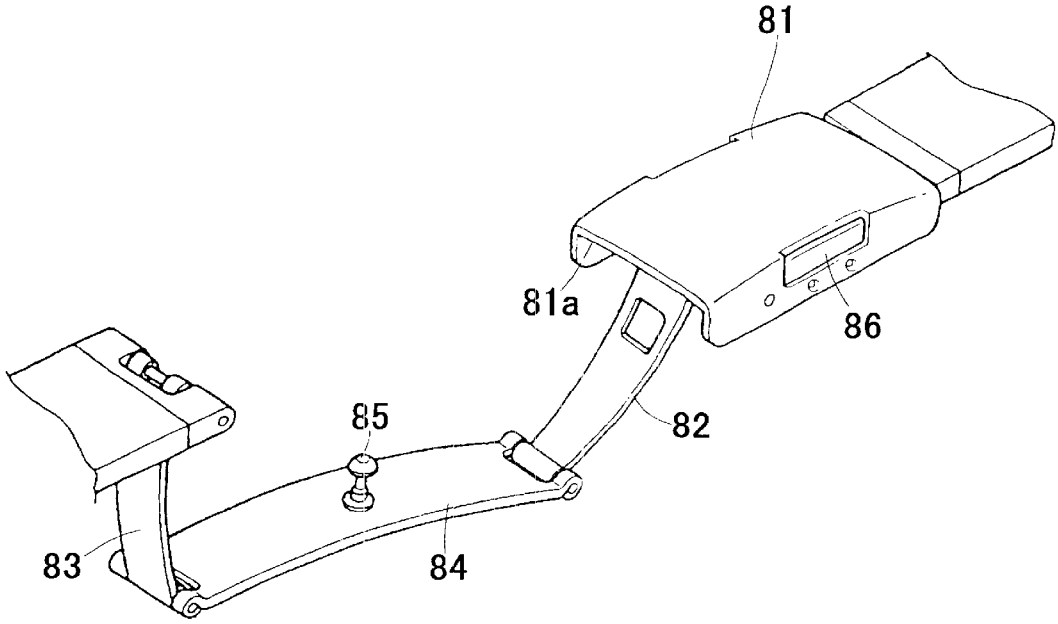
FIG. 20 is a perspective view showing a fifth embodiment.

FIG. 20 is a perspective view showing an opposed buckle which opens like a casement window and which comprises a surface cover 81, a pair of middle pates 82 and 83, and a lower plate 84. Although the surface cover 81 and the inner structure thereof are the same as those of the first embodiment, an end 81*a* of the upper plate of the surface cover is designed to largely overhang.

The middle plate 83 is shorter than the middle plate 82 so as to be able to rotate above the lower plate 84 to a position facing a lock projection 85. On the other hand, the hooks of the push buttons 86 engage the lock projection 85, under which condition the end 81*a* of the upper plate of the surface cover holds down the middle plate 83 from above to lock the buckle. The other constructions and operations are the same as those of the first embodiment.

Sixth Embodiment

Figure 21:
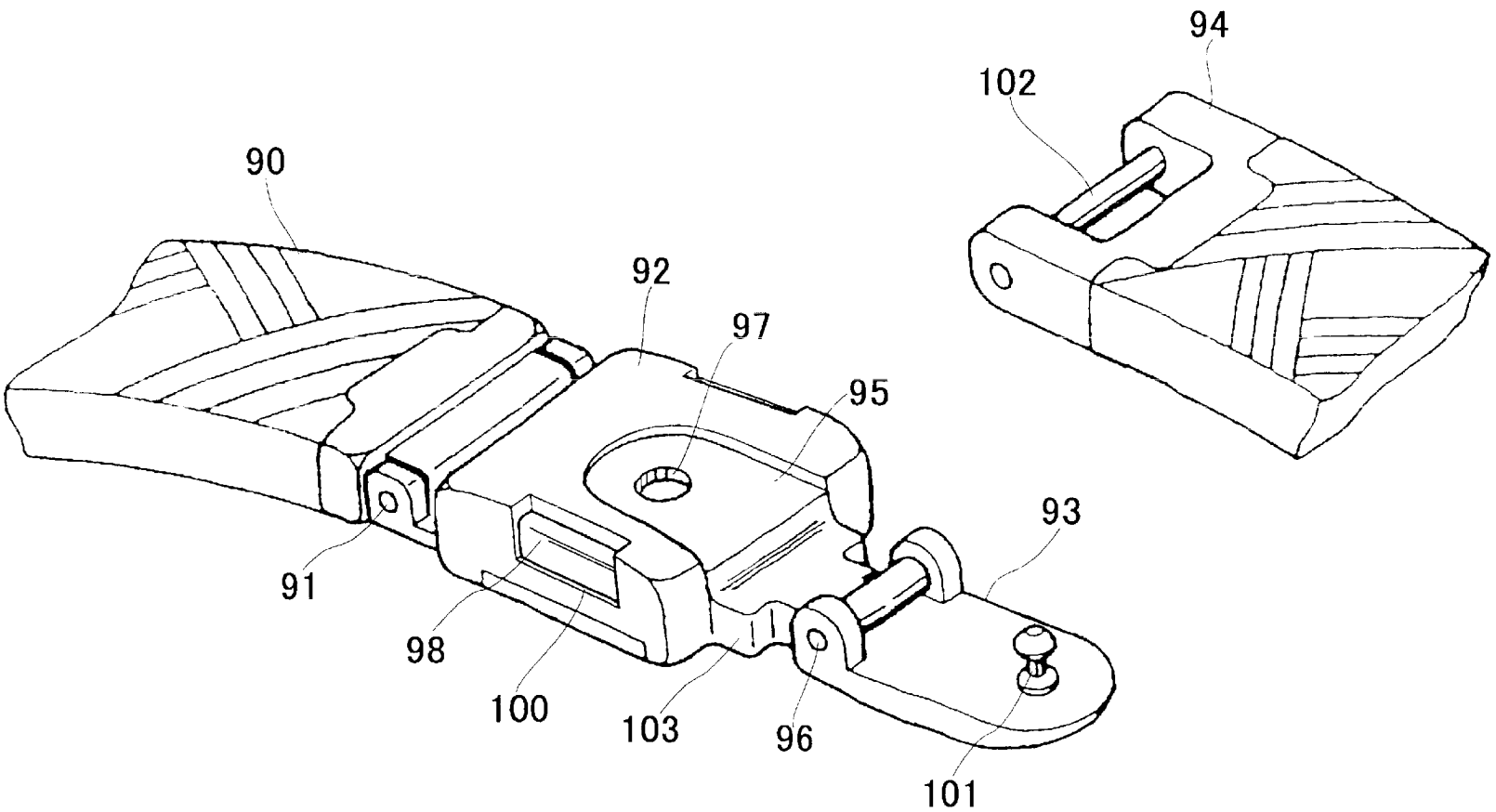
FIG. 21 is a perspective view showing the operation.
Figure 22:
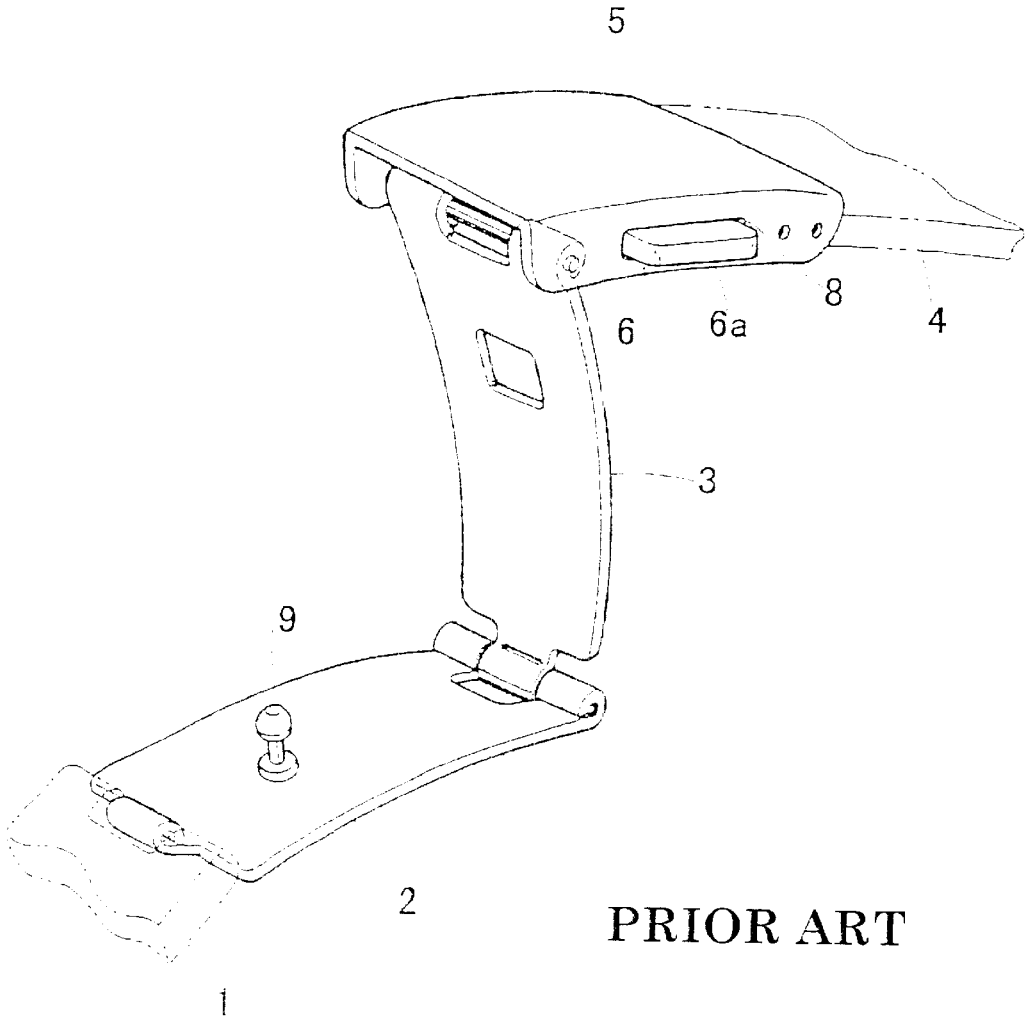
FIGS. 22 and 23 are perspective views showing a conventional buckle.
Figure 23:
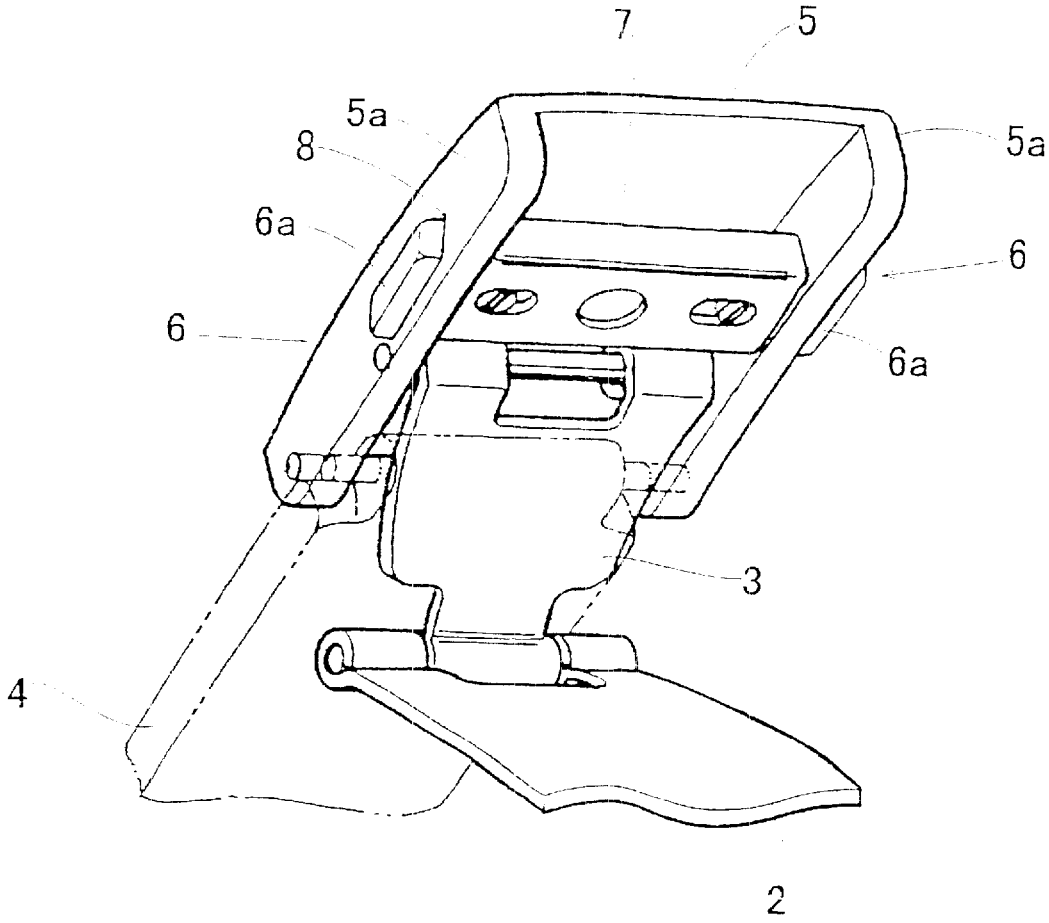
Figure 24:
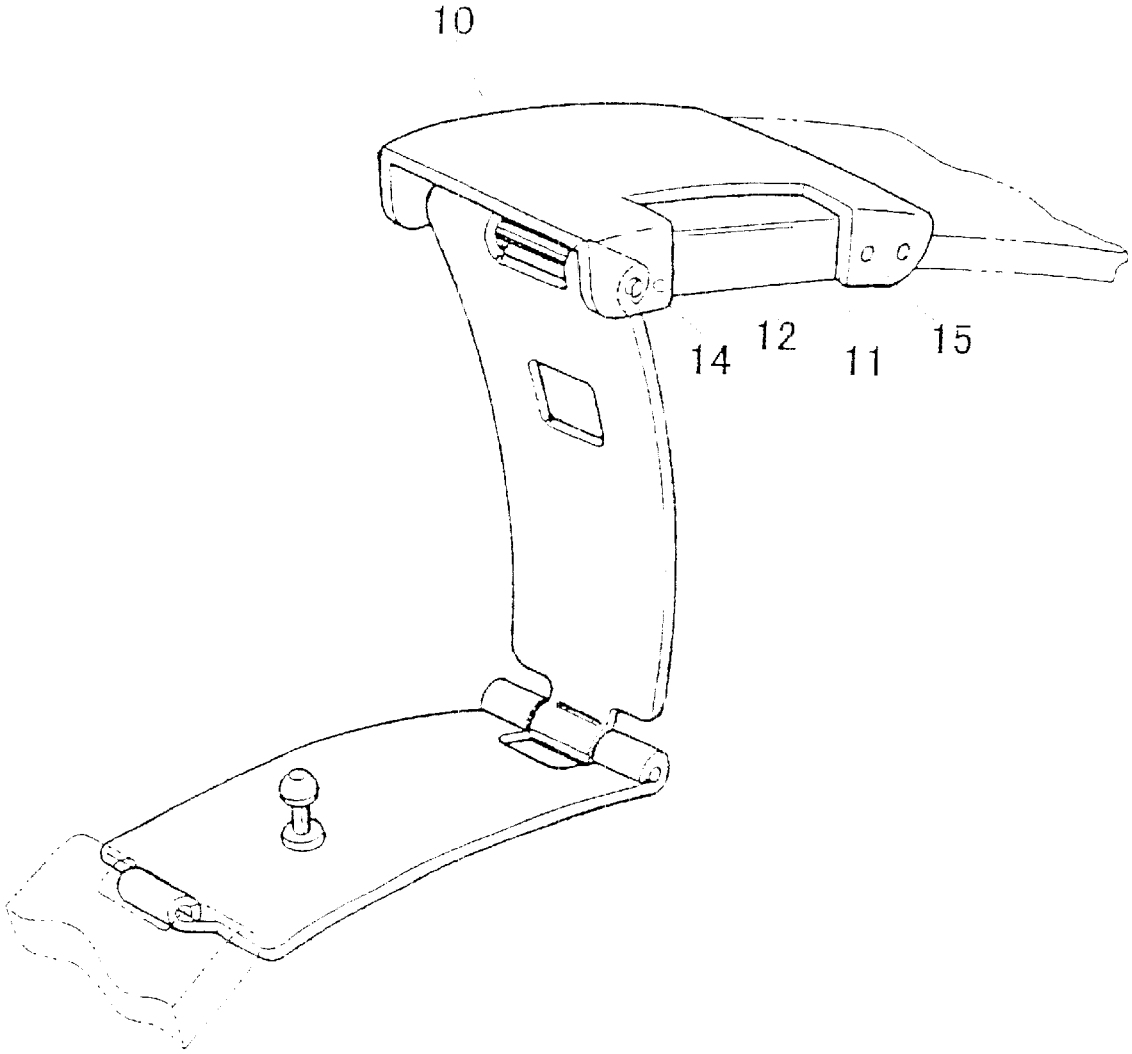
FIGS. 24 and 25 are perspective views showing another conventional buckle.
Figure 25:
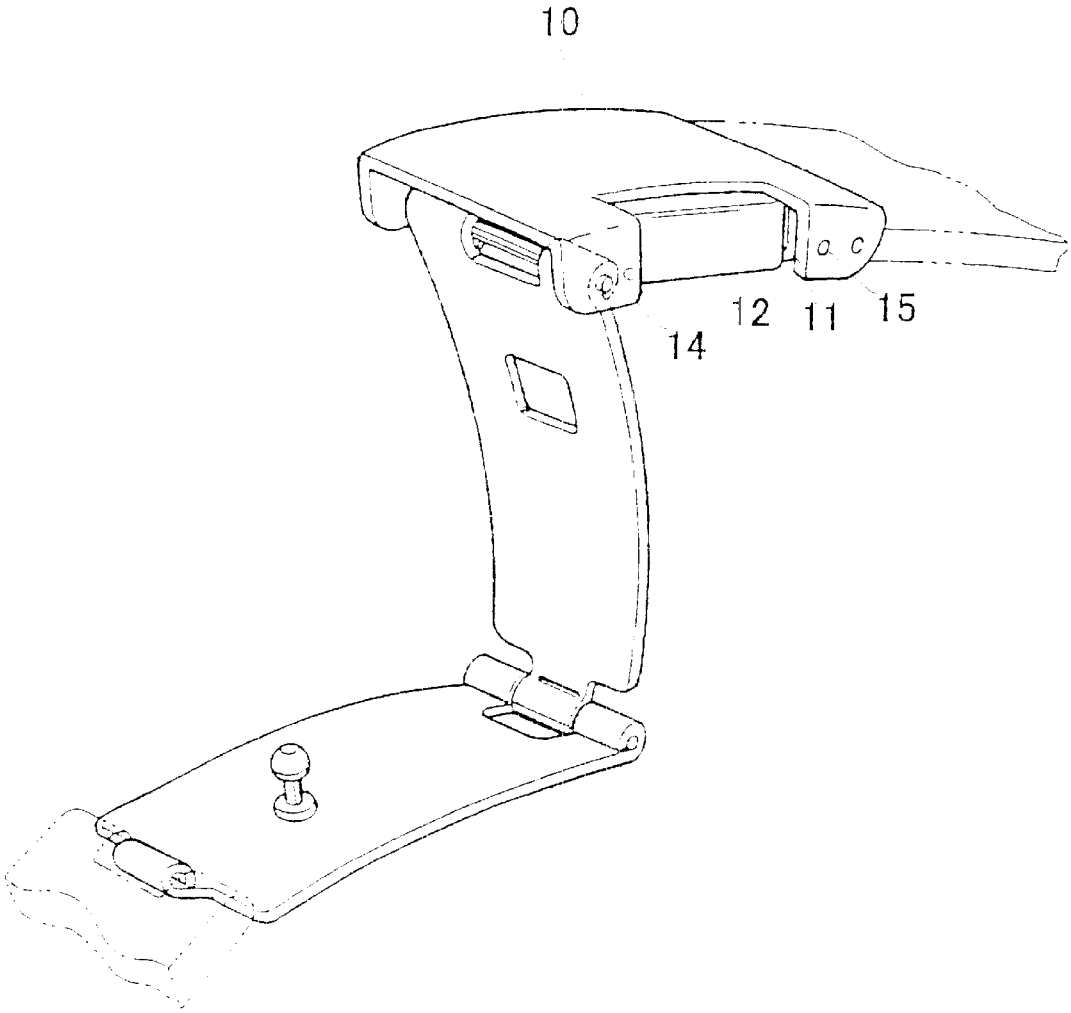

FIG. 21 is a perspective view showing the sixth embodiment of the present invention. The buckle comprises a supporting member 92 which is rotatably connected to an end of a watchband by a pin 91, an upper plate 93 rotatably connected to the supporting member 92 by a pin 96, and a connecting link 94 connected to the other end of the band.

On the upper surface of the supporting member 92, there is formed a recess 95 in which the upper plate is engaged. In the recess 95 there is formed a circular opening 97 for engaging a lock device in the buckle. The lock device within the buckle has the same structure as that of the first embodiment and push buttons 98 and openings 100 have the same structures as those of the first embodiment.

The upper plate 93 has a lock projection 101 on the underside thereof, and the projection 101 has a semispherical head which corresponds to the opening 97 in the recess 95. The attached connecting link 94 is provided with a lateral connecting shaft 102

In order to connect the buckle, the upper plate 93 is inserted from below into a space at inner side of the connecting shaft 102 of the connecting link 94. The connecting shaft 102 is placed on a supporting arm 103 which projects from the supporting member 92 and the upper plate 93 is rotated about the pin 96 over the connecting shaft 102. The upper plate 93 is depressed to abut against the recess 95 so that the lock projection 101 is inserted in the opening 97 of the recess and engages the hooks of the push buttons 98 to lock the buckle.

When releasing the buckle, both of the push buttons 98 are simultaneously depressed and the upper plate 93 is released in the reverse order as described above.

PROBABILITY OF INDUSTRIAL EXPLOITATION

In accordance with the present invention, since the remaining portions of the side walls are formed at the lower portion below the openings which are formed in the side walls and from which the manipulating portions of the push buttons are exposed, an external force unintentionally exerted from the sides of the supporting member is blocked by the remaining portions without being applied to the push buttons. Hence the danger of the buckle releasing due to an inadvertent depressing of the push buttons is prevented. The components of the buckle are made of metal plate so that the buckle can be easily manufactured by cutting and bending a plate member. The thickness of the manipulating portions of the push buttons can be increased so as to facilitate the pressing operation with the fingers.

What is claimed is:

1. A buckle for a personal adornment band comprising:

a supporting member having an upper plate, a pair of side walls and an opening formed in at least one of the side walls and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is pushed in against the urging of the elastic member;

characterized in that the opening is formed in a range between a part of the upper plate of the supporting member and an intermediate portion of the side wall so as to expose the manipulating portion of the push button in a recess at the part of the upper plate, thereby leaving a remaining portion at a lower portion of the side wall, the push button being disengaged from the lock member by inserting the manipulating portion into the recess.

2. The buckle for a personal adornment band according to claim 1 wherein the opening of the side wall is formed by cutting the upper plate, corresponding to a thickness of the side wall.

3. The buckle for a personal adornment band according to claim 1 wherein an end surface of the manipulating portion of the push button is substantially flush with a side surface of the supporting member.

4. The buckle for a personal adornment band according to claim 1 wherein an opening is formed in each of opposite side walls of the supporting member, and the manipulating portion of the push button is exposed in each opening.

5. The buckle for a personal adornment band according to claim 1 wherein each element is formed by machining a metal plate.

6. A buckle for a personal adornment band comprising:

a supporting member having an opening and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member;

characterized in that the manipulating portion comprises an upright portion and a folded portion extending inward from the upright portion and has a substantially L shaped section.

7. The buckle for a personal adornment band according to claim 6 wherein the manipulating portion projects out from the side wall of the supporting member a length corresponding to a thickness smaller than the thickness of the manipulating portion.

8. The buckle for a personal adornment band according to claim 7 wherein the length which the manipulating portion of the push button projects out from the side wall of the supporting member is smaller than a stroke of the push button which is sufficient for releasing the buckle.

9. The buckle for a personal adornment band according to claim 6 wherein each element is formed by machining a metal plate.

10. A buckle for a personal adornment band comprising:

a supporting member having an opening and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member;

characterized in that a guide housing for housing the push button and the elastic member is provided in the supporting member and the guide housing is vertically supported by projections projecting from inner walls of the supporting member.

11. The buckle for a personal adornment band according to claim 10 further having a middle plate connected to the supporting member, and a lower plate connected to the middle plate and to the other end of the personal adornment band, upright reinforcing portion is formed on each side edge of the lower plate, and recesses formed in each reinforcing portion so that the projections of the supporting member are inserted in the recesses in the closed state of the buckle.

12. The buckle for a personal adornment band according to claim 10 wherein each element is formed by machining a metal plate.

13. A buckle for a personal adornment band comprising:

a supporting member having an opening and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member;

characterized in that the manipulating portion of the push button is made of a metal unlikely to cause metal allergy on skin, and an abutting portion abutting against the lock member is made of metal different from metal of the manipulating portion.

14. The buckle for a personal adornment band according to claim 13 wherein the manipulating portion of the push button is made of a non-nickel-containing metal or a stainless steel having a low percentage of nickel content.

15. The buckle for a personal adornment band according to claim 13 wherein the manipulating portion of the push button is made of either one of titanium, titanium alloy, a ferritic stainless steel, and a stainless steel having a low percentage of nickel content.

16. The buckle for a personal adornment band according to claim 13 wherein a hook of the push button is made of an austenitic stainless steel.

17. The buckle for a personal adornment band according to claim 13 wherein each element is formed by machining a metal plate.

18. A personal adornment band having a buckle, the buckle comprising:

a supporting member having an upper plate, a side wall and an opening formed in at least one of the side walls and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is pushed in against the urging of the elastic member;

characterized in that the opening is formed in a range between a part of the upper plate of the supporting member and an intermediate portion of the side wall so as to expose the manipulating portion of the push button in a recess at the part of the upper plate, thereby leaving a remaining portion at a lower portion of the side walls, the push button being disengaged from the lock member by inserting the manipulating portion into the recess.

19. A personal adornment band having a buckle, the buckle comprising:

a supporting member having an opening and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member;

characterized in that the manipulating portion comprises an upright portion and a folded portion extending inward from the upright portion and has a substantially L shaped section.

20. A personal adornment band having a buckle, the buckle comprising:

a supporting member having an opening and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member;

characterized in that a guide housing for housing the push button and the elastic member is provided in the supporting member, and the guide housing is vertically supported by projections projecting from inner walls of the supporting member.

21. A personal adornment band having a buckle, the buckle comprising:

a supporting member having an opening and connected to an end of the personal adornment band;

a push button slidably mounted in the supporting member, and having a manipulating portion and an engaging portion;

a lock member provided in the buckle so as to be engaged with the engaging portion of the push button;

an elastic member provided in the supporting member for urging the push button toward the opening wherein, the push button urged by the elastic member is engaged with the lock member to lock the buckle in a closed state, the push button is disengaged from the lock member when the push button is depressed against the urging of the elastic member;

characterized in that the manipulating portion of the push button is made of a metal unlikely to cause metal allergy on skin, and an abutting portion abutting against the lock member is made of metal different from metal of the manipulating portion.

* * * * *